US006289196B1

(12) United States Patent
Hsieh et al.

(10) Patent No.: US 6,289,196 B1
(45) Date of Patent: Sep. 11, 2001

(54) OXIDIZED TRANSPORT DONOR ROLL COATINGS

(75) Inventors: Bing R. Hsieh, Webster, NY (US); Yuan Yu, North Billerica, MA (US); William H. Wayman, Ontario, NY (US); Donald S. Stanton, Penfield, NY (US); Allen J. Thompson, Sodus, NY (US); Michelle L. Schlafer, Fairport, NY (US); Ann M. Kazakos, Webster, NY (US); Heiko Rommelmann, Webster, NY (US); Alan R. Kuntz, Webster, NY (US); Steven C. Hart, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/128,160

(22) Filed: Aug. 3, 1998

(51) Int. Cl.[7] ..... G03G 15/08; G03G 15/02; G03G 15/04; H01B 1/12; H01B 1/06

(52) U.S. Cl. ..... 399/266; 430/59; 430/62; 430/75; 252/500; 252/519.33; 252/519.34; 252/519.4

(58) Field of Search ..... 428/335, 412, 428/423.1, 423.5, 423.7, 473.5, 474.4, 474.7, 475.2, 480; 430/59, 62, 75; 252/300, 519.33, 519.34, 519.4; 399/266

(56) References Cited

U.S. PATENT DOCUMENTS

| | | | | |
|---|---|---|---|---|
| 4,338,222 | | 7/1982 | Limburg et al. | 252/500 |
| 4,868,600 | | 9/1989 | Hays et al. | 355/259 |
| 5,162,183 | * | 11/1992 | Lindblad et al. | 430/59 |
| 5,172,170 | | 12/1992 | Hays et al. | 355/259 |
| 5,264,312 | | 11/1993 | Stolka et al. | 430/130 |
| 5,300,339 | | 4/1994 | Hays et al. | 428/36.9 |
| 5,368,967 | * | 11/1994 | Schank et al. | 430/59 |
| 5,386,277 | | 1/1995 | Hays et al. | 355/259 |
| 5,448,342 | | 9/1995 | Hays et al. | 355/259 |
| 5,549,851 | | 8/1996 | Fukushima et al. | 252/519 |
| 5,587,224 | | 12/1996 | Hsieh et al. | 428/195 |
| 5,643,706 | * | 7/1997 | Brillson et al. | 430/127 |
| 5,731,078 | | 3/1998 | Hsieh et al. | 428/335 |
| 5,853,906 | * | 12/1998 | Hsieh | 428/690 |

* cited by examiner

*Primary Examiner*—Paul Thibodeau
*Assistant Examiner*—Holly C. Rickman
(74) *Attorney, Agent, or Firm*—Amette L. Bade

(57) ABSTRACT

A donor member useful in ionographic or electrophotographic apparatuses and preferably useful in hybrid scavengeless development units, having a substrate and an oxidized transport coating including charge transport molecules, polymer binder, and an oxidized oligo arylamine salt comprising a cation of an oligo arylamine molecule and a counter anion.

20 Claims, 3 Drawing Sheets

OXIDIZED TRANSPORT DONOR ROLL COATINGS

CROSS REFERENCE TO RELATED APPLICATIONS

Attention is directed to copending application U.S. patent application Ser. No. 09/487,288, filed Jan. 19, 2000, pending entitled, "Crosslinked Polymer Oxidized Transport Compositions. The disclosure of these applications is hereby incorporated by reference in their entirety.

BACKGROUND OF THE INVENTION

The present invention relates to coatings for ionographic or electrophotographic, including digital and image on image, imaging and printing apparatuses and machines, and more particularly is directed to coatings for donor members and particularly donor members including electrodes closely spaced therein to form a toner powder cloud in the development zone to develop a latent image. The present invention is directed, in embodiments, to suitable conductive and semiconductive overcoatings, especially for donor member or transport members like scavengeless or hybrid scavengeless development systems.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed. Two component and single component developer materials are commonly used for development. Toner particles are attracted to the latent image forming a toner powder image on the photoconductive surface, the toner image is subsequently transferred to a copy sheet, and finally, the toner powder image is heated to permanently fuse it to the copy sheet in image configuration.

One type of development system is a single component development system such as a scavengeless development system that uses a donor roll for transporting charged toner (single component developer) to the development zone. At least one, and preferably a plurality of electrode members, are closely spaced to the donor member in the development zone. An AC voltage is applied to the electrode members forming a toner cloud in the development zone. The electrostatic fields generated by the latent image attract toner from the toner cloud to develop the latent image.

Another type of development system is a two component development system such as a hybrid scavengeless development system which employs a magnetic brush developer member for transporting carrier having toner (two component developer) adhering triboelectrically thereto. A donor member is used in this configuration also to transport charged toner to the development zone. The donor member and magnetic member are electrically biased relative to one another. Toner is attracted to the donor member from the magnetic member. The electrically biased electrode members detach the toner from the donor member forming a toner powder cloud in the development zone, and the latent image attracts the toner particles thereto. In this way, the latent image recorded on the photoconductive member is developed with toner particles.

Coatings for donor members are known and may contain a dispersion of conductive particles in a dielectric binder. The desired volume resistivity is achieved by controlling the loading of the conductive material. However, very small changes in the loading of conductive materials at or near the percolation threshold can cause dramatic changes in resistivity. Furthermore, changes in the particle size and shape of such materials can cause wide variations in the resistivity at constant weight loading. A desired volume resistivity of the coating is from about $10^7$ to about $10^{13}$ ohms-cm, and preferably from about $10^8$ to about $10^{11}$ ohms-cm. If the resistivity is too low, electrical breakdown of the coating can occur when a voltage is applied to an electrode or material in contact with the coating. Also, resistive heating can cause the formation of holes in the coating. When the resistive heating is too high, charge accumulation on the surface of the overcoating can create a voltage which changes the electrostatic forces acting on the toner. The problem of the sensitivity of the resistivity to the loading of conductive materials in an insulative dielectric binder is avoided, or minimized with the coatings of the present invention.

Currently, ceramic materials are used for donor members such as donor members used in hybrid scavengeless development apparatuses. Several problems are associated with use of ceramic materials including non-uniform thickness, non-uniform run-out, pin hole defects, and rough surface finish. These problems can result in print defects. The problems are not easily overcome because they may be related to the deformation of substrate during high temperature thermal spray coating of ceramic materials. Grinding the ceramic coatings is needed to provide the desired surface finish. This additional, difficult, and low yield manufacturing process results in high unit manufacturing costs. In addition, the electrical conductivity of ceramic coating cannot be easily controlled and reproduced.

However, with the coatings of the present invention, the above problems with use of ceramic materials are reduced or eliminated.

Other coatings for donor members are described in the literature including the following patents.

U.S. Pat No. 5,300,339 discloses a coated toner transport roll containing a core with a coating thereover.

U.S. Pat No. 5,172,170 to Hays et al., discloses an apparatus in which a donor roll advances toner to an electrostatic latent image recorded on a photoconductive member. The donor roll includes a dielectric layer disposed about the circumferential surface of the roll between adjacent grooves.

U.S. Pat No. 5,386,277 discloses a coated toner donor member wherein the coating comprises oxidized polyether carbonate.

U.S. Pat No. 5,448,342 discloses a coated transport means comprising a core and a coating comprising charge transporting molecules and oxidizing agent or agents dispersed in a binder.

U.S. Pat No. 4,338,222 discloses an electrically conducting composition comprising an organic hole transporting compound and the reaction product of an oxidizing agent capable of accepting one electron from the hole transporting compound.

U.S. Pat No. 5,587,224 discloses a coated donor roll comprising a core with a coating comprising a photolysis reaction product of a charge transporting polymer and a photoacid compound.

U.S. Pat No. 5,264,312 discloses a process for preparing a photoreceptor by forming a coating following curing. The coating comprises an electroactive material dispersed in a polymerizable film forming monomer, which is first polymerized into a solid matrix.

U.S. Pat No. 5,731,078 discloses a coated donor roll comprising a substrate with a coating comprising a charge transport molecules, the metal salts of an organic acid and a polymer binder.

U.S. Pat. No. 5,853,906 discloses a conductive coating comprising an oxidized oligomer salt, a charge transport component, and a polymer binder, for example, a conductive coating comprising an oxidized tetratolyidiamine salt.

There exists a need for a donor member coating which provides conductivity or resistivity within a desired range, minimizes residue voltage, is relatively uniform and virtually free from defects and pinholes, provides good wear resistance for up to several million, for example 10 million copies, provides consistent performance with variable temperature and humidity, is low in cost and is environmentally acceptable.

SUMMARY OF THE INVENTION

Embodiments of the present invention include: a donor member comprising a substrate and having thereover an oxidized transport coating comprising charge transport molecules, polymer binder, and an oxidized oligo arylamine salt comprising a cation of an oligo arylamine molecule and a counter anion.

In addition, embodiments include: an apparatus for developing a latent image recorded on a surface, comprising: wire supports; a donor member spaced from the surface and being adapted to transport toner to a region opposed from the surface, wherein said donor member comprises a substrate and having thereover an oxidized transport coating comprising charge transport molecules, polymer binder, and an oxidized oligo arylamine salt comprising a cation of an oligo arylamine molecule and a counter anion; and an electrode member positioned in the space between the surface and said donor member, said electrode member being closely spaced from said donor member and being electrically biased to detach toner from said donor member thereby enabling the formation of a toner cloud in the space between said electrode member and the surface with detached toner from the toner cloud developing the latent image.

Moreover, embodiments include: an image forming apparatus for forming images on a recording medium comprising a charge-retentive surface to receive an electrostatic latent image thereon; a development component to apply toner to said charge-retentive surface to develop said electrostatic latent image to form a developed image on said charge retentive surface, said development component comprising a donor member comprising a substrate and having thereover an oxidized transport coating comprising charge transport molecules, polymer binder, and an oxidized oligo arylamine salt comprising a cation of an oligo arylamine molecule and a counter anion; and a transfer component to transfer the developed image from said charge retentive surface to a copy substrate.

BRIEF DESCRIPTION OF THE DRAWINGS

For a better understanding of the present invention, reference may be had to the accompanying figures.

DETAILED DESCRIPTION OF THE PRESENT INVENTION

The present invention relates to coatings for donor members in development units for electrostatographic, including digital and image on image, imaging and printing apparatuses, and especially for hybrid scavengeless development units.

Figure 1:
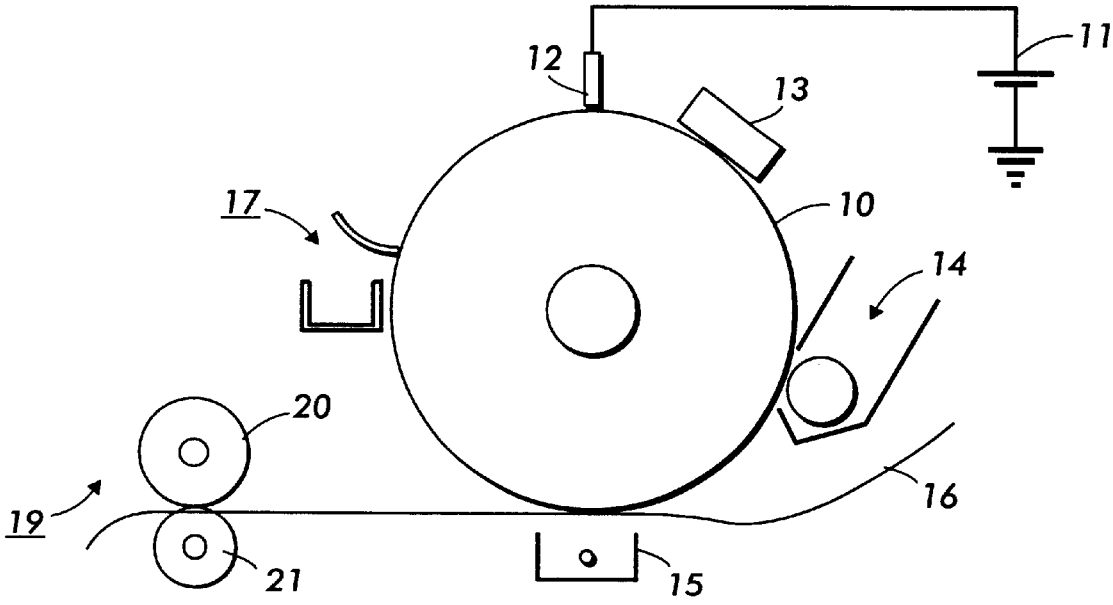
FIG. 1 is a schematic illustration of an image apparatus in accordance with the present invention.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member, or bias transfer member, and subsequently transferred to a copy sheet. Examples of copy substrates include paper, transparency material such as polyester, polycarbonate, or the like, cloth, wood, or any other desired material upon which the finished image will be situated.

After the transfer of the developed image is completed, copy sheet 16 advances to fusing station 19, depicted in FIG. 1 as fuser roll 20 and pressure roll 21 (although any other fusing components such as fuser belt in contact with a pressure roll, fuser roll in contact with pressure belt, and the like, are suitable for use with the present apparatus), wherein the developed image is fused to copy sheet 16 by passing copy sheet 16 between the fusing and pressure members, thereby forming a permanent image. Alternatively, transfer and fusing can be effected by a transfix application.

Photoreceptor 10, subsequent to transfer, advances to cleaning station 17, wherein any toner left on photoreceptor 10 is cleaned therefrom by use of a blade (as shown in FIG. 1), brush, or other cleaning apparatus.

Figure 2:
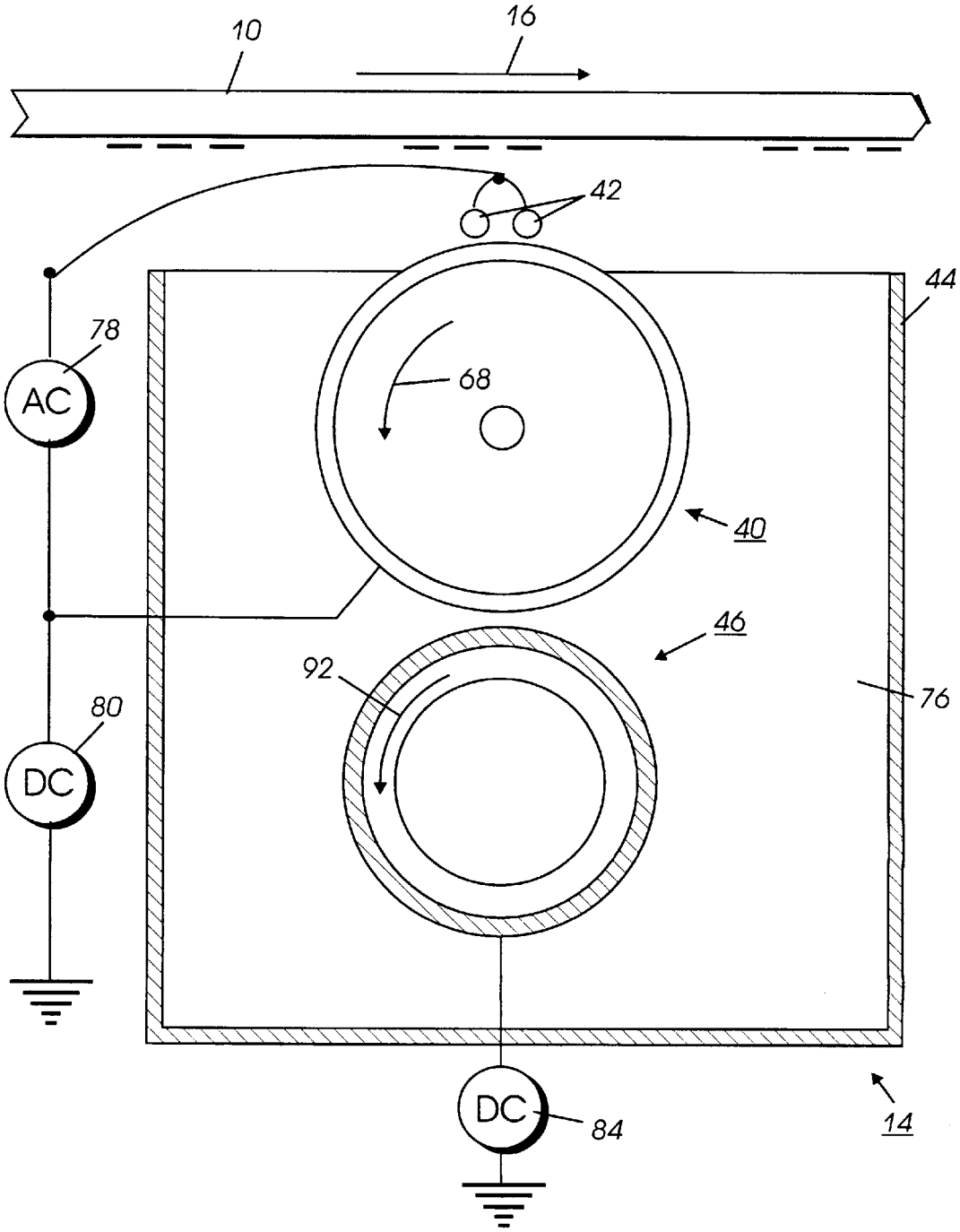
FIG. 2 is a schematic illustration of an embodiment of a development apparatus useful in an electrophotographic printing machine.

Referring now to FIG. 2, in a preferred embodiment of the invention, developer unit 14 develops the latent image recorded on the photoconductive surface 10. Preferably, developer unit 14 includes donor roller 40 and electrode member or members 42. Electrode members 42 are electrically biased relative to donor roll 40 to detach toner therefrom so as to form a toner powder cloud in the gap between the donor roll 40 and photoconductive surface 10. The latent image attracts toner particles from the toner powder cloud forming a toner powder image thereon. Donor roller 40 is mounted, at least partially, in the chamber of developer housing 44. The chamber 76 in developer housing 44 stores a supply of developer material which is a two component developer material of at least carrier granules having toner particles adhering triboelectrically thereto. A magnetic roller 46 disposed interior of the chamber of housing 44 conveys the developer material to the donor roller 40. The magnetic roller 46 is electrically biased relative to the donor roller so that the toner particles are attracted from the magnetic roller to the donor roller.

The donor roller can be rotated in either the 'with' or 'against' direction relative to the direction of motion of photoreceptor 10. In FIG. 2, donor roller 40 is shown rotating in the direction of arrow 68. Similarly, the magnetic roller can be rotated in either the 'with' or 'against' direction relative to the direction of motion of belt 10. In FIG. 2, magnetic roller 46 is shown rotating in the direction of arrow 92. Photoreceptor 10 moves in the direction of arrow 16.

A pair of electrode members 42 are shown extending in a direction substantially parallel to the longitudinal axis of the donor roller 40. The electrode members are made from one or more thin (i.e., 50 to 100 $\mu$m in diameter) stainless steel or tungsten electrode members which are closely spaced from donor roller 40. The distance between the electrode members and the donor roller is from about 5 to about 35 $\mu$m, preferably about 10 to about 25 $\mu$m or the thickness of the toner layer on the donor roll. The electrode members are self-spaced from the donor roller by the thickness of the toner on the donor roller.

As illustrated in FIG. 2, an alternating electrical bias is applied to the electrode members by an AC voltage source 78. The applied AC establishes an alternating electrostatic field between the electrode members and the donor roller is effective in detaching toner from the photoconductive member of the donor roller and forming a toner cloud about the electrode members, the height of the cloud being such as not to be substantially in contact with the photoreceptor 10. The magnitude of the AC voltage is relatively low and is in the order of 200 to 500 volts peak at a frequency ranging from about 9 kHz to about 15 kHz. A DC bias supply 80 which applies approximately 300 volts to donor roller 40 establishes an electrostatic field between photoconductive member 10 and donor roller 40 for attracting the detached toner particles from the cloud surrounding the electrode members to the latent image recorded on the photoconductive member. At a spacing ranging from about 10 $\mu$m to about 40 $\mu$m between the electrode members and donor roller, an applied voltage of 200 to 500 volts produces a relatively large electrostatic field without risk of air breakdown. A DC bias supply 84 which applies approximately 100 volts to magnetic roller 46 establishes an electrostatic field between magnetic roller 46 and donor roller 40 so that an electrostatic field is established between the donor roller and the magnetic roller which causes toner particles to be attracted from.

In an alternative embodiment of the present invention, one component developer material consisting of toner without carrier may be used. In this configuration, the magnetic roller 46 is not present in the developer housing. This embodiment is described in more detail in U.S. Pat No. 4,868,600, the disclosure of which is hereby incorporated by reference in its entirety.

Figure 3:
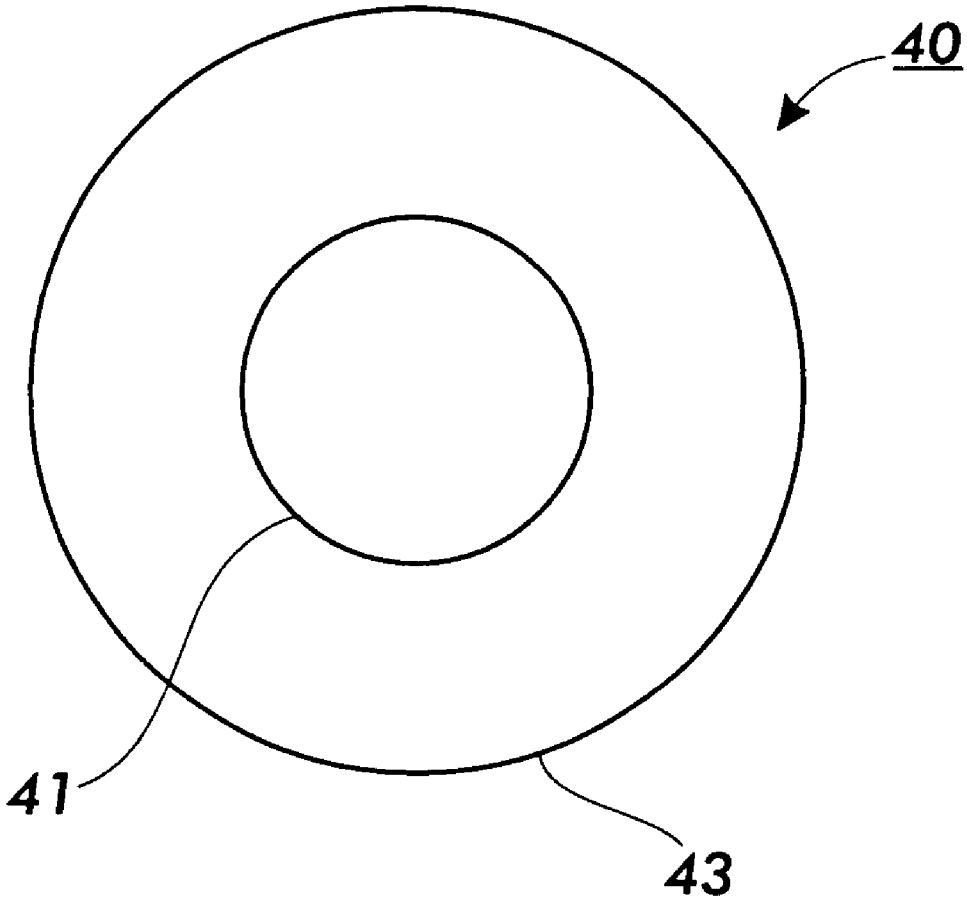
FIG. 3 is a fragmentary schematic illustration of a development housing comprising a donor roll and an electrode member.

The donor member of the present invention may be in the form of a donor roller as depicted in FIGS. 2 and 3. As shown in FIG. 3, the donor member 40 includes a substrate 41 which may comprise metal substrates such as, for example, copper, aluminum, nickel, and the like metals, plastics such as, for example, polyesters, polyimides, polyamides, and the like, glass and like substrates, which may be optionally coated with thin metal films, and a coating 43 including a semi-conductive relaxation layer which is an oxidized transport layer. The oxidized transport layer comprises charge transporting molecules, polymer binder, and an oxidized oligo arylamine salt complex.

The charge transporting molecules can be any known charge transporting molecules such as those described in U.S. Pat Nos. 5,264,312; 4,338,222; 5,386,277; 5,448,342 and 5,587,224, the disclosures each of which are incorporated herein in their entirety.

Particularly preferred charge transport materials, either molecular doped into polymer binder, or as incorporated into polymeric structures, are para-substituted arylamine charge transport compounds.

The arylamine charge transport compound can be of the alternative formulas:

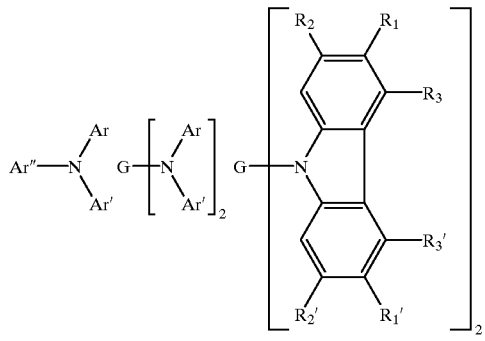

-continued

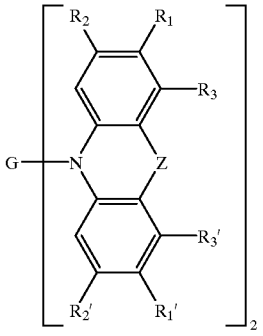

wherein Ar, Ar', and Ar" are independently selected from unsubstituted and substituted aromatic groups with from about 6 to about 30 carbon atoms, for example, phenyl, 3-methylphenyl, 4-methylphenyl, 3,4-dimethylphenyl, 4-ethylphenyl, 4-t-butylphenyl, 4-methoxyphenyl, 4-bromophenyl, 4-chlorophenyl, 3-iodophenyl, 4-fluorophenyl, 4-phenylphenyl, 2-naphthyl, 1-naphthyl, and the like, and mixtures thereof, and $R_1$, $R_2$, $R_3$, $R_1'$, $R_2'$, and $R_3'$ are independently selected from the group consisting of hydrogen, bromine, chlorine, fluorine, alkyl .groups with from about 1 to about 24 carbon atoms such as methyl, ethyl, propyl, butyl, isobutyl, and the like, and alkoxy groups with from about 1 to about 24 carbon atoms such as methoxy, ethoxy, isobutoxy, and the like, Z is selected from the atoms O, S, Se, or a substituent —$CH_2$—, G is an alkylene group with from about 1 to about 12 carbon atoms or a group selected from the partial formulas:

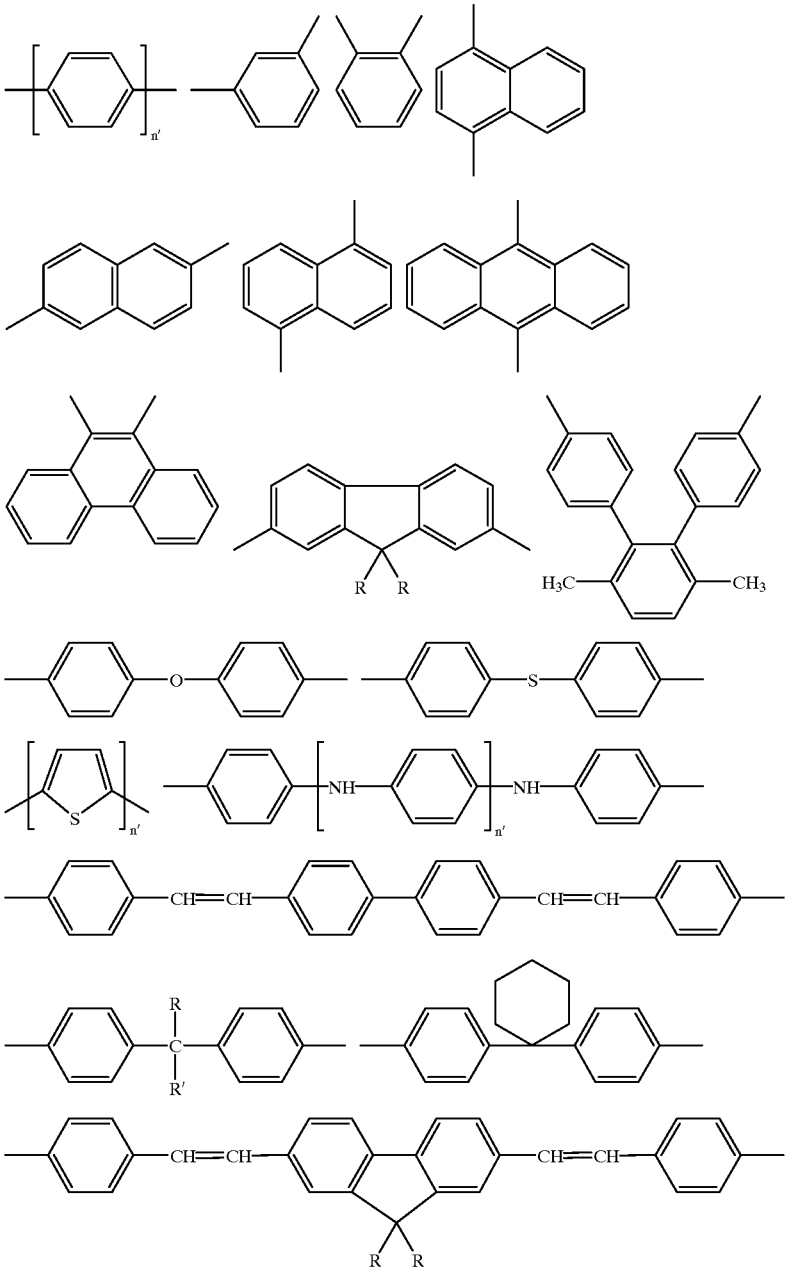

-continued

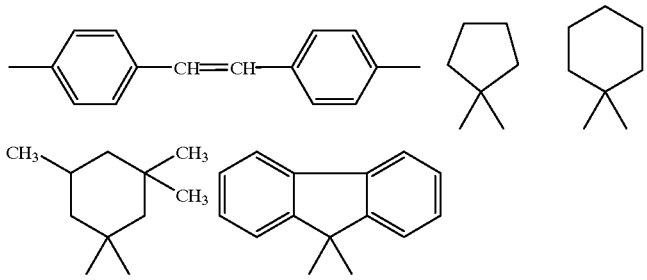

wherein n' is an integer of from about 1 to about 12, and R and R' are alkyl groups with, for example, from about 1 to about 12 carbon atoms such as methyl, ethyl, propyl and the like.

The arylamine charge transport compound can include the following arylamine compounds and mixtures thereof:

a) aryldiamine compounds of the formula:

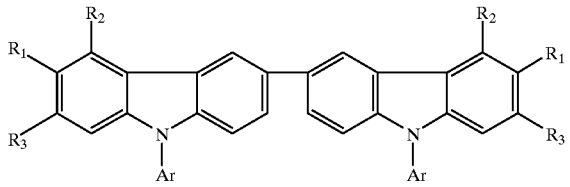

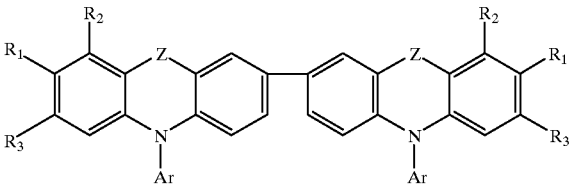

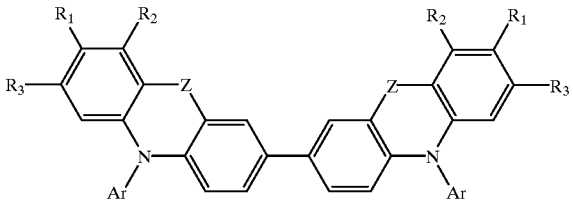

-continued

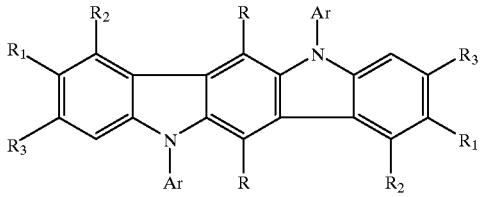

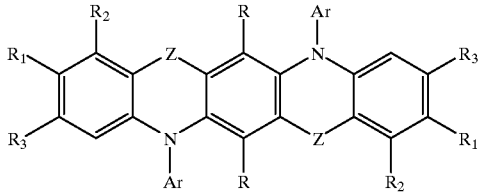

wherein Ar is a substituted or unsubstituted aromatic group, for example, phenyl, 3-methylphenyl, 4-methylphenyl, 3,4-dimethylphenyl, 4-ethylphenyl, 4-t-butylphenyl, 4-methoxyphenyl, 4-bromophenyl, 4-chlorophenyl, 3-iodophenyl, 4-fluorophenyl, 4-phenylphenyl, 2-naphthyl, 1-naphthyl, and the like, and mixtures thereof, $R_1$, $R_2$ and $R_3$ areindependently selected from the group consisting of hydrogen, bromine, chlorine, fluorine, alkyl groups with from about 1 to about 24 carbon atoms, and alkoxy groups with from about 1 to about 24 carbon atoms, and Z is selected from an atom O, S, Se, or a methylene substituent —$CH_2$—;

b) aryltriamines compounds of the formula:

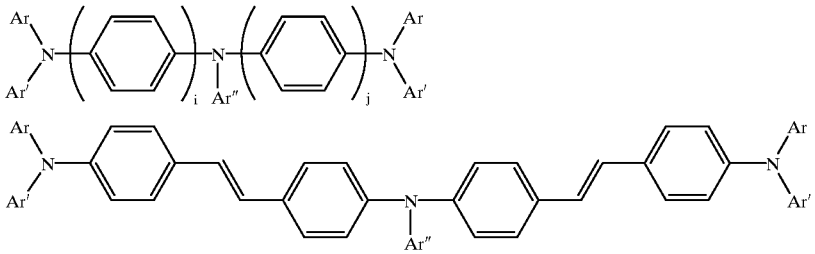

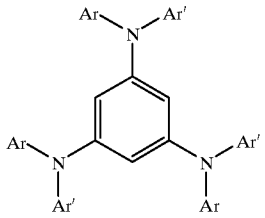
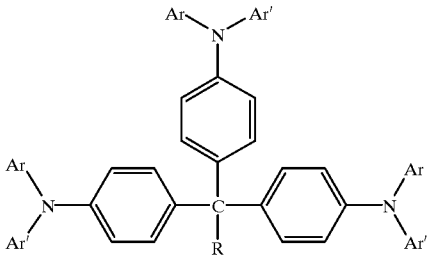
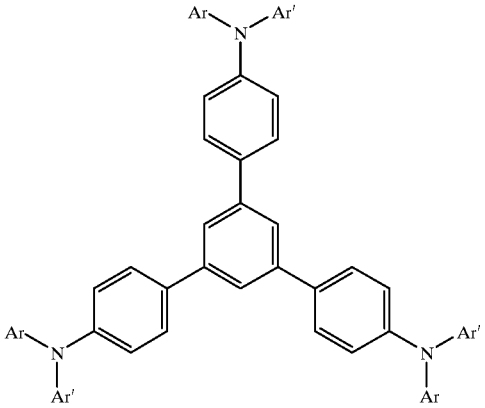
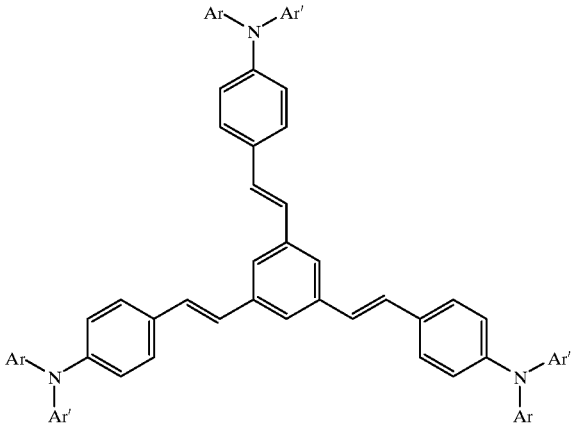
wherein Ar and Ar' are independently selected from substituted and unsubstituted aromatic groups, R is selected from hydrogen, phenyl containing from about 6 to about 20 carbon atoms and alkyl groups containing from about 1 to about 12 carbon atoms, and wherein i and j are integers of from about 1 to about 2;
c) aryltetraamines compounds of the formula:
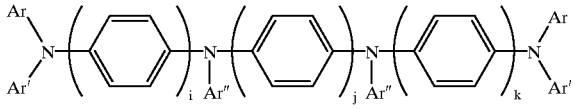
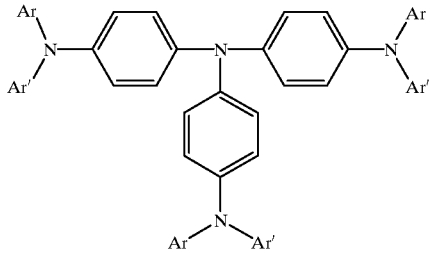
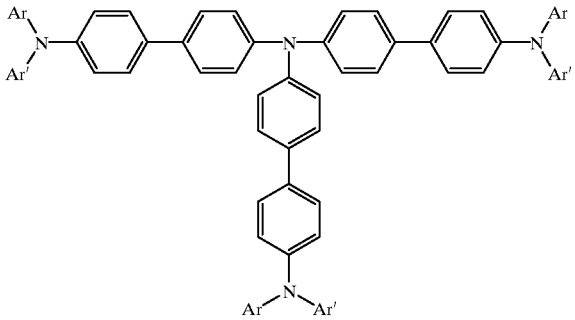
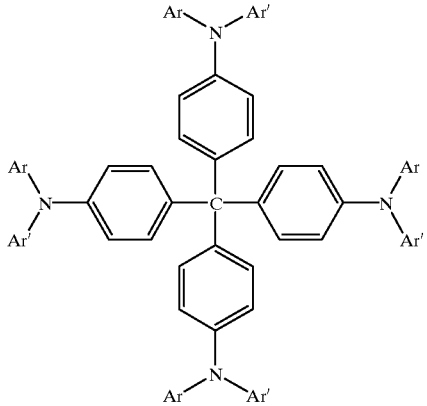

-continued

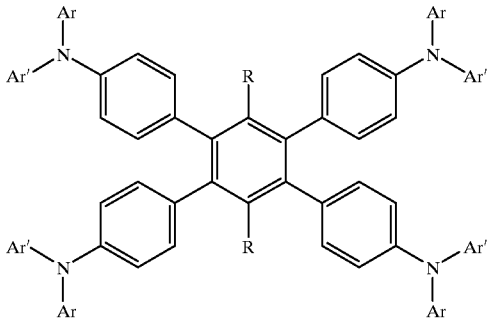

-continued

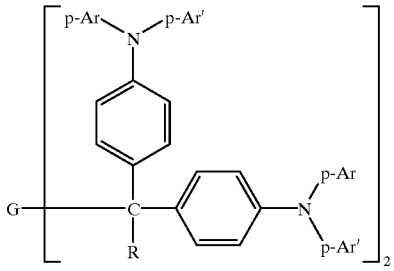

wherein Ar, Ar', and Ar" are independently selected from substituted and unsubstituted aromatic groups with from about 6 to about 20 carbon atoms, p-Ar and p-Ar are independently selected from para-substituted aromatic groups with from about 6 to about 20 carbon atoms, R is selected from hydrogen, phenyl with from about 6 to about 20 carbon atoms and alkyl groups containing from about 1 to about 12 carbon atoms, i, j, and k are integers 1 or 2, G is an alkylene group with from about 1 to about 12 carbon atoms such as methylene, ethylene, propylene, butene and the like, or a group selected from the partial formulas:

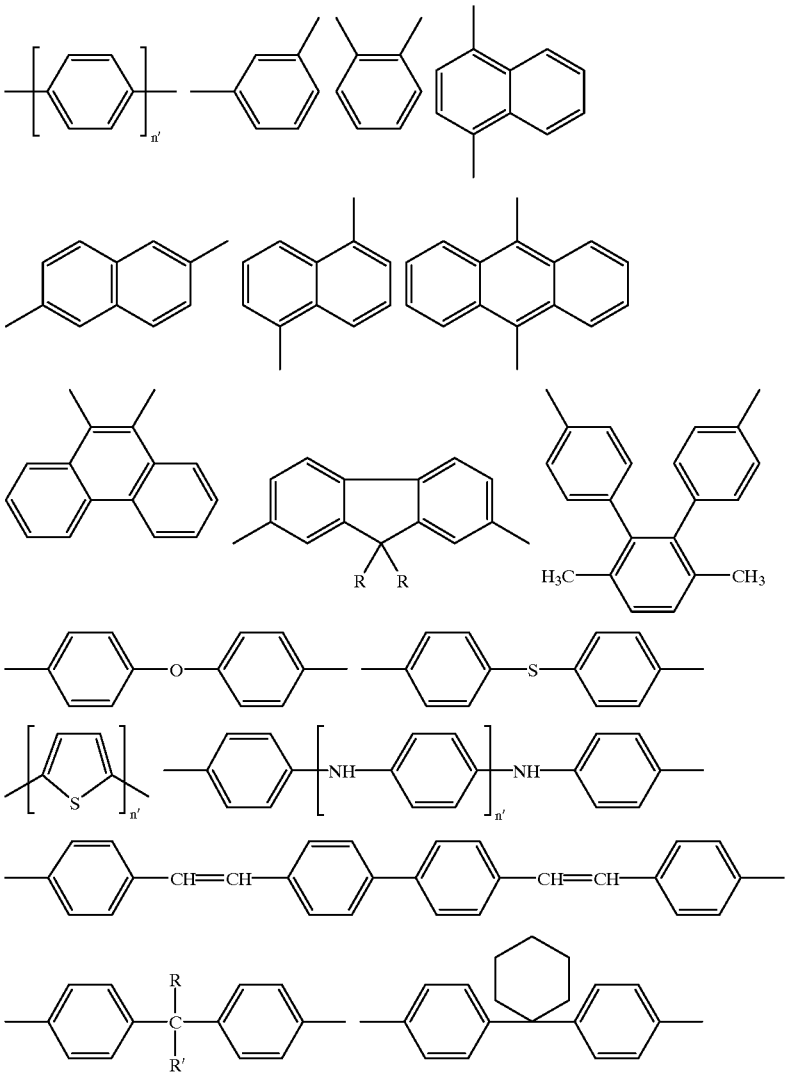

-continued

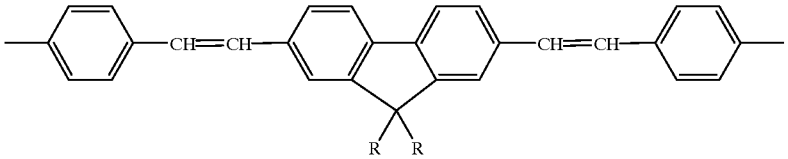

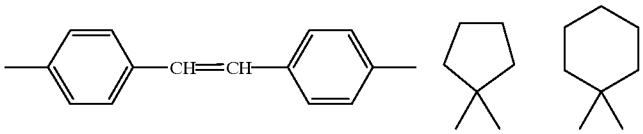

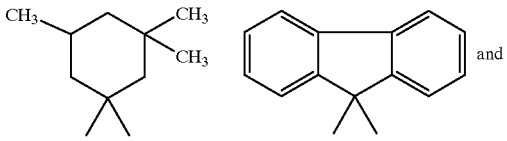

wherein n' is an integer from about 1 to about 12, and R and R' are alkyl groups with from about 1 to about 12 carbon atoms;

d) arylpentaamines compounds of the formula:

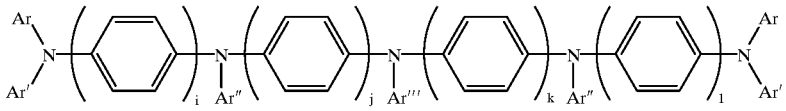

wherein Ar, Ar', Ar", and Ar'" are independently selected from substituted and unsubstituted aromatic groups with from about 6 to about 20 carbon atoms, and i, j, k, and I are integers of 1 or 2; and e) arylhexaamines compounds of the formula:

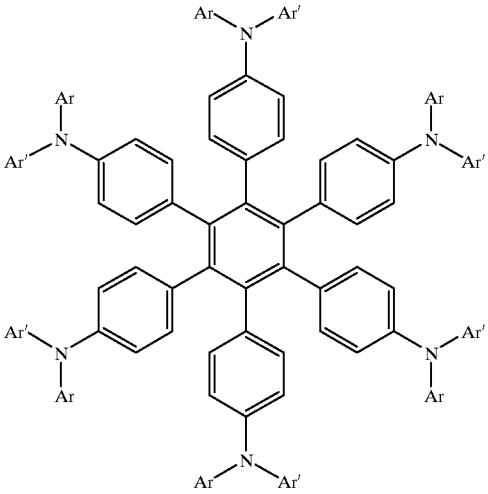

-continued

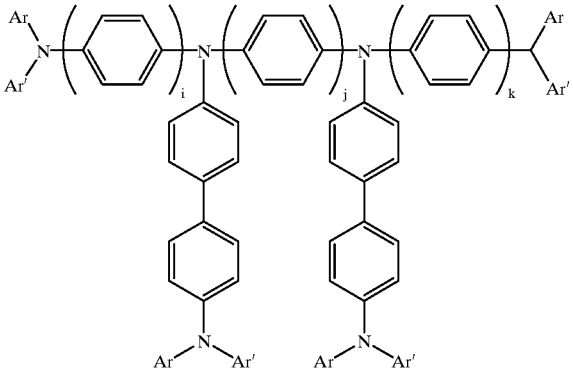

-continued

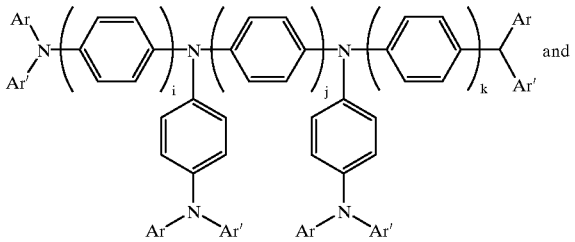

and

-continued

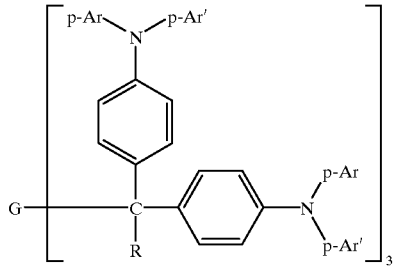

wherein Ar and Ar' are independently selected from substituted and unsubstituted aromatic groups with from about 6 to about 20 carbon atoms, p-Ar and p-Ar' are para-substituted aromatic groups with from about 6 to about 20 carbon atoms, i, j, and k are integers of 1 or 2, G is a alkylene group with from about 1 to about 12 carbon atoms or an aromatic group selected from the formulas:

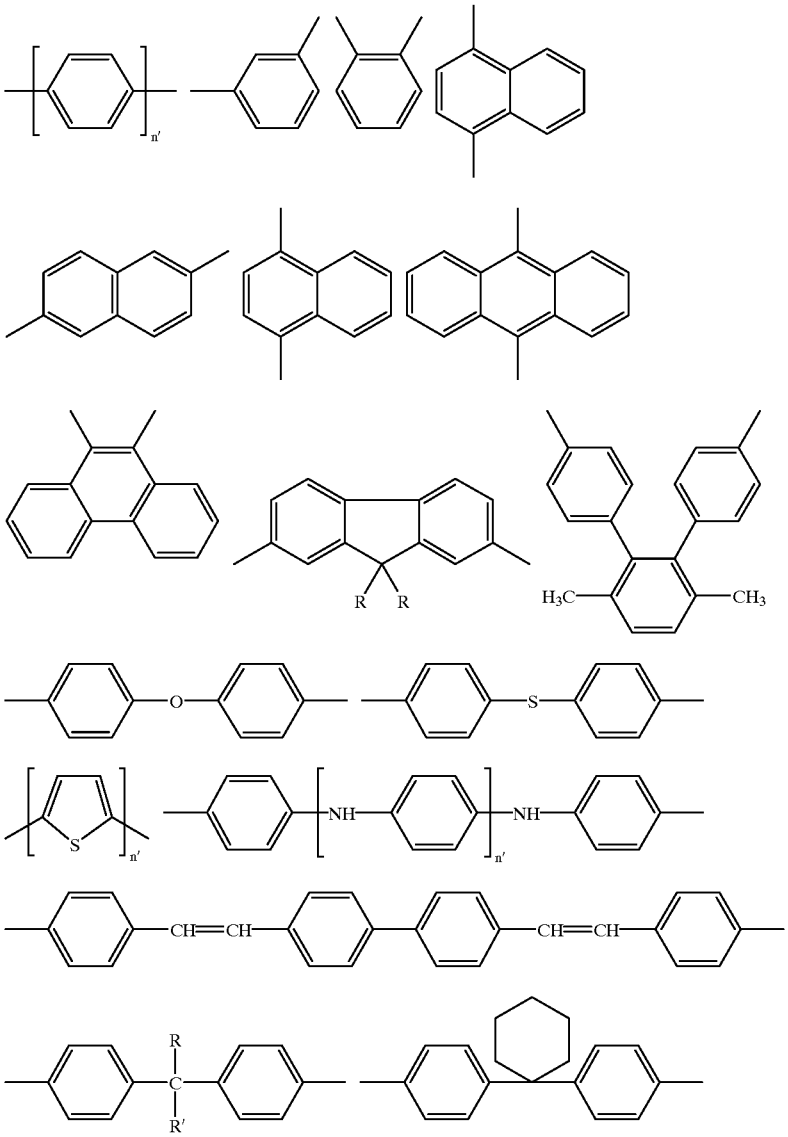

-continued

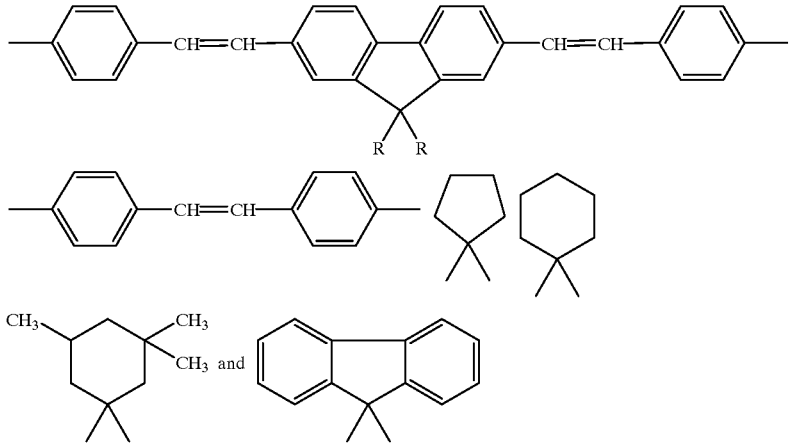

wherein n' is an integer from about 1 to about 12, and R and R' are alkyl groups with from about 1 to about 12 carbon atoms.

The arylamine charge transport compound can be para-substituted triarylamine compounds with at least one of the para-substituted molecular segments selected from the partial formulas:

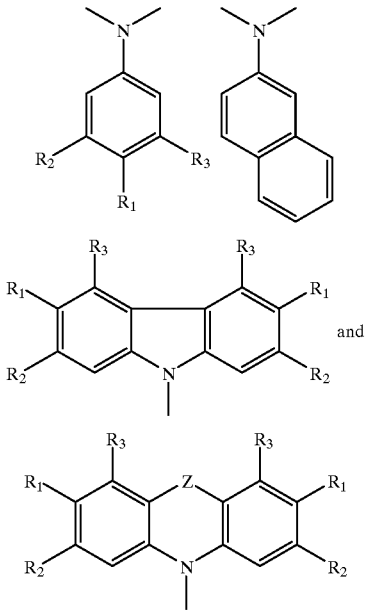

wherein $R_1$ is selected from the group consisting of bromine, chlorine, fluorine, alkyl groups with from about 1 to about 24 carbon atoms, and alkoxy groups with from about 1 to about 24 carbon atoms, $R_2$ and $R_3$ are independently selected from the group consisting of hydrogen, bromine, chlorine, fluorine, alkyl groups with from about 1 to about 24 carbon atoms, and alkoxy groups with from about 1 to about 24 carbon atoms, and Z is an atom of O, S, Se, or a methylene substituent —$CH_2$—.

A preferred charge transport polymer, in embodiments, is selected from polymers that contain a para-substituted aryldiamine unit of the formula:

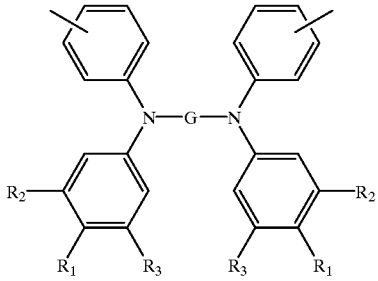

wherein $R_1$ is selected from the group consisting of bromine, chlorine, fluorine, alkyl groups containing from about 1 to about 24 carbon atoms, and alkoxy groups containing from about 1 to about 24 carbon atoms, $R_2$ and $R_3$ are independently selected from the group consisting of hydrogen, bromine, chlorine, fluorine, alkyl groups containing from about 1 to about 24 carbon atoms, such as methyl, ethyl, butyl, isobutyl, cyclohexyl, and the like, and alkoxy groups containing from about 1 to about 24 carbon atoms, G is selected from the group consisting of alkaline groups of from about 1 to about 12 carbon atoms and of the formulas:

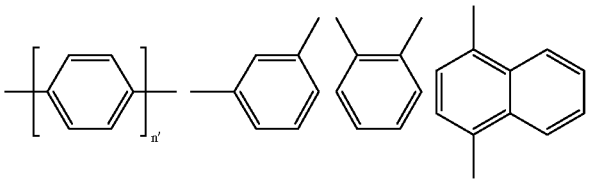

-continued
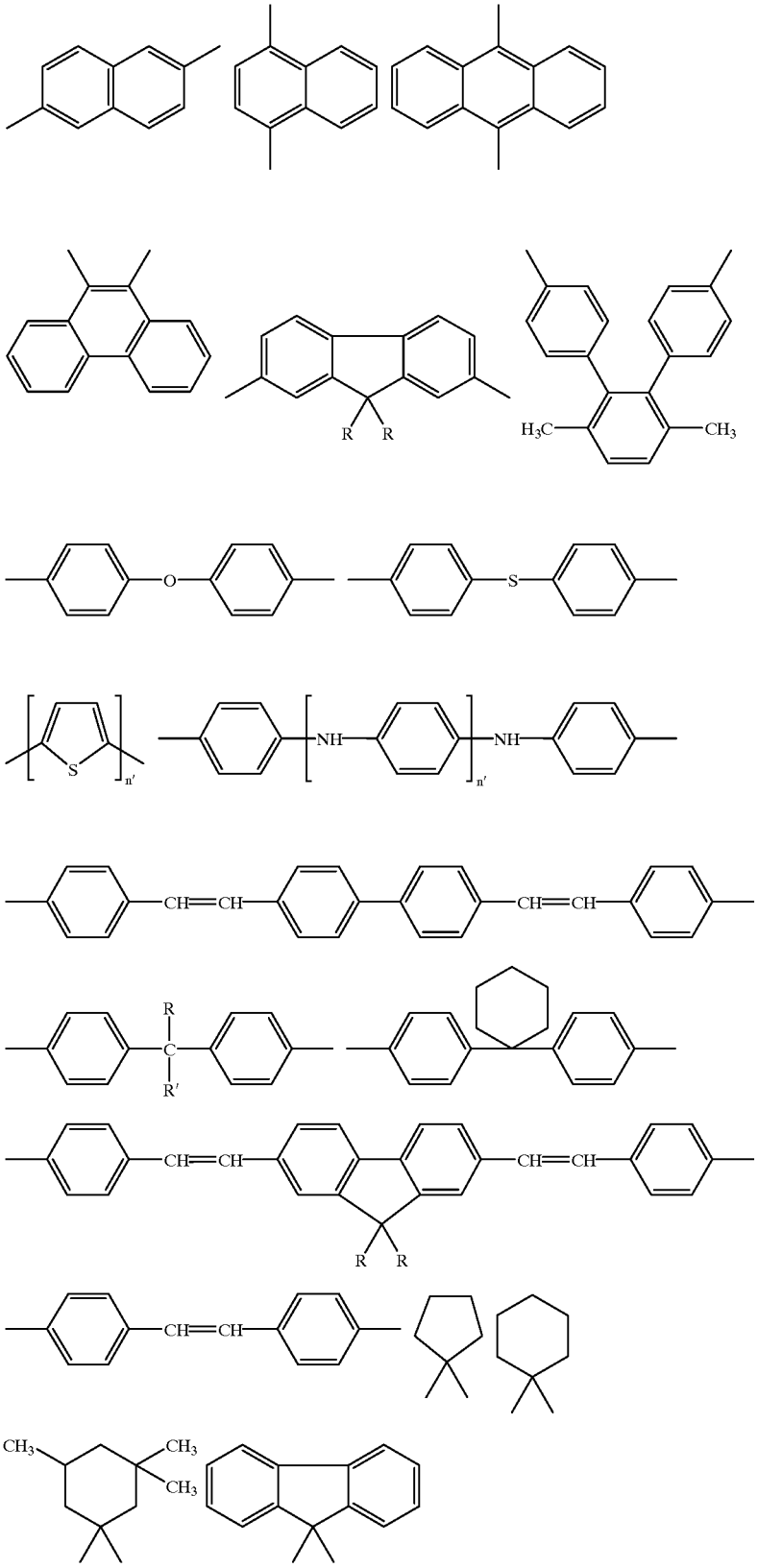

wherein n' is an integer of from about 1 to about 12, and R and R' are alkyl groups with from about 1 to about 12 carbon atoms.

Preferred charge transport molecules include N,N'-diphenyl-N,N'-bis(m-methylphenyl)-(1,1'-biphenyl)-4,4'-diamine (TPD) and N,N,N',N'-tetra-p-tolyl-1,1'-biphenyl-4,4'-diamine (TM-TPD). A particularly preferred charge transport molecule includes a para-substituted tetramethyl TPD such as that having the formula:

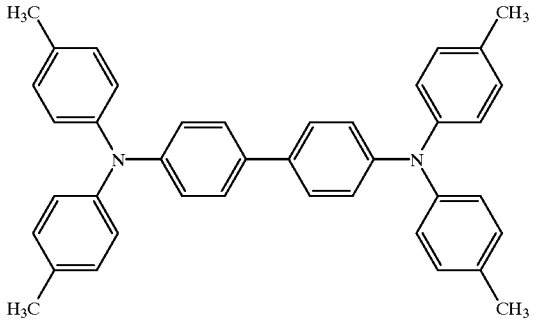

wherein the oxidized form of the para-substituted arylamine charge transport compound results from photo-oxidation with photo-oxidants such as diphenyliodonium salts and diarylsulfonium salts.

The charge transport molecule is present in the oxidized transfer coating in an amount of from about 1 to about 80 percent, and preferably from about 20 to about 60 weight percent based on the weight of total coating.

The polymer binder can be an inert polymer binder such as solvent processable and melt processable thermoplastics and elastomeric thermoplastics such as polystyrenes, polycarbonates, polyesters, polyimides, polyurethanes, polysulfones, polyethersulfones, polyether ketones, polyamides, and the like, and their copolymers and polymer blends, and mixtures thereof.

The polymer binder, in embodiments, can be an inert polymer, one or more, for example up to about 5, charge transport polymer, and mixtures thereof, and selected in an amount of from about 30 to about 80 weight percent based on the total weight of the oxidized transfer coating. When the polymer binder selected is a polymeric charge transport compound, examples thereof include polyvinylcarbazoles, polythiophenes, polysilanes, polyanilines, poly(arylene vinylenes), poly(phenylene vinylenes), polyphenylenes, polyfluorenes, poly(phenylene sulfides), polyanilines, poly (phenylene sulfide phenylenamine), copolymers thereof containing triarylamine charge transport groups, and mixtures thereof. In a preferred embodiment, the arylamine charge transport compound is a para-substituted arylamine charge transport material, including polymers having para-substituted arylamine charge transport molecules molecularly doped therein, for example, in amounts of from about 20 to about 70 weight percent based on the total weight of the coating, and charge transport polymers containing para-substituted arylamine groups, that is, covalently bound arylamine groups in a main or pendant polymer chain, and mixtures thereof.

The preferred poly(arylene vinylenes) include the following formula:

(I)

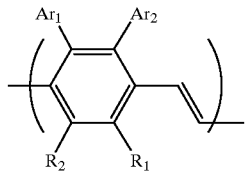

(II)

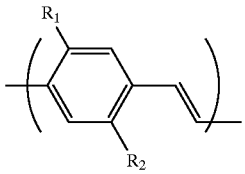

(III)

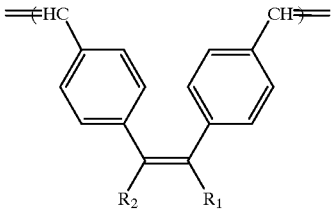

(IV)

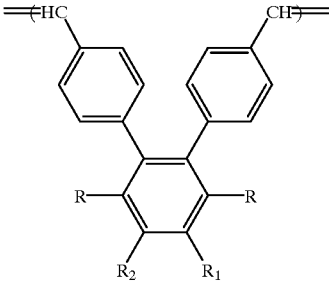

wherein $Ar_1$ and $Ar_2$ are substituted or unsubstituted aromatic groups with from about 6 to about 40 carbon atoms, R, $R_1$ and $R_2$ are aromatic groups, alkyl groups, alkylthio groups, alkoxy groups, phenoxy groups, or perfluoroalkyl groups with from about 1 to about 24 carbon atoms; R can be hydrogen, ketone or ester groups. Structures (I) and (II) can be obtained by polymerization of the corresponding 1,4-bishalomethylbenzenes in the presence of a base and structures (III) and (IV) can be obtained by ring-opening metathesis polymerization of the corresponding paracyclophenes. The preferred polyfluorenes and related copolymers include:

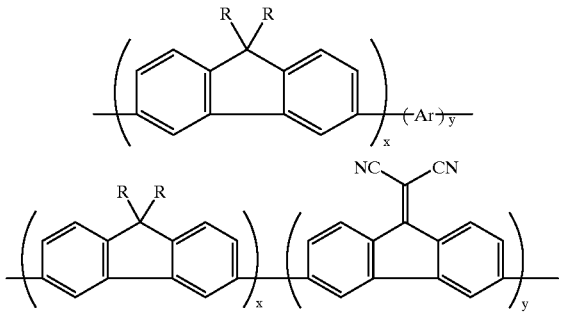

-continued

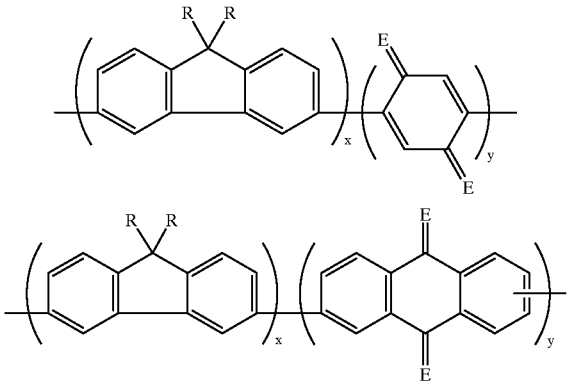

wherein R is alkyl or aromatic group with from about 1 to about 40 carbon atoms, Ar is a vinylene, acetylene or divalent aromatic group with from about 1 to about 40 carbon atoms, E is $O_2$ or $C(CN)_2$ and the ratio of y/x+y is in the range of from about 0 to about 0.8. The polyfluorenes and related copolymers can be obtained by metal catalyzed coupling polymerization. Similar polymers have been disclosed in U.S. Pat No. 5,708,130.

The polymer binder is present in the oxidized transfer coating in an amount of from about 20 to about 99 weight percent and preferably from about 40 to about 80 weight percent based on the weight of the coating. The weight ratio of a charge transport polymer binder to an inert polymer binder can be in the range of from about 0.01 to about 80 percent by weight.

Suitable oxidized oligo arylamine salts comprise a cation of an oligo arylamine and a counter anion. Oligo, as used herein, refers to any compound having two or more than two amine groups such as, for example, diamine, triamine, tetraamine, pentaamine, and the like. Examples of such oligo arylamine salts include those having the formula TM-X or $TM_2$-Y, wherein TM is the cation of an oligo arylamine charge transport molecule such as those listed above, and wherein X is a monovalent counter anion selected from the group consisting of $BF4^-$, $PF_6^-$, $AsF_6^-$, $SbF_6^-$, $ClO_4^-$, $AuCl_4^-$, $C_{60}^-$, $I^-$, $Br_3^-$, $I_3^-$, $FeCl_4^-$, $SnCl_5^-$, $PO_3^-$, $(CF_3SO_3)_4Al^-$, $(CF_3SO_3)_4Ga^-$, $(CF_3SO_3)_4Ta^-$, $(CF_3SO_3)_4B^-$, trifluoroacetate benzoate, nitrobenzoate, toluenesulfonate, p-bromobenzenesulfonate, p-nitrobenzenesulfonate, trifluoromethanesulfonate, nonafluorobutanesulfonate, 2,2,2-trifluoroethanesulfonate, tetraphenylborate, anionic tetracyanoquinodimethane, and bis(trifluoromethanesulfonyl)imide; $Y^{2-}$ is a divalent counter anion selected from the group consisting of $SiF_6^{2-}$, $GeF_6^{2-}$, $TiF_6^{2-}$, $TaF_7^{2-}$, $NbF_7^{2-}$, $RuCl_6^{2-}$, $OsCl_6^{2-}$, $IrCl_6^{2-}$, $PdCl_4^{2-}$, $PdCl_6^{2-}$, $PdI_4^{2-}$, $PtCl_4^{2-}$, $PtCl_6^{2-}$, $PtBr_6^{2-}$, $IrCl_6^{2}$, $ZrF_6^{2-}$, squarate, benzenedisulfonate, $B_{12}H_{12}^{2-}$, and $C_{60}^{2-}$.

Preferably, the oxidized oligo arylamine salt is of a formula selected from the group consisting of:

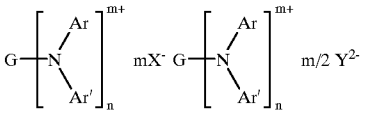

and mixtures thereof, wherein G is an aromatic group with from about 6 to about 24 carbon atoms and connects to all the diarylamine groups, Ar and Ar' are substituted or unsubstituted aromatic groups with from about 6 to about 18 carbon atoms, n is an integer of from about 2 to about 36, m is an integer which is less than or equal to n, $X^-$ is a monovalent counter anion selected from the group consisting of $BF_4^-$, $PF_6^-$, $AsF_6^-$, $SbF_6^-$, $ClO_4^-$, $AuCl_4^-$, $C_{60}^-$, $I^-$, $Br_3^-$, $I_3^-$, $FeCl_4^-$, $SnCl_5^-$, $PO_3^-$, $(CF_3SO_3)_4Al^-$, $(CF_3SO_3)_4Ga^-$, $(CF_3SO_3)_4Ta^-$, $(CF_3SO_3)_4B^-$, trifluoroacetate, benzoate, nitrobenzoate, toluenesulfonate, p-bromobenzenesulfonate, p-nitrobenzenesulfonate, trifluoromethanesulfonate, nonafluorobutanesulfonate, 2,2,2-trifluoroethanesulfonate, tetraphenylborate, anionic tetracyanoquinodimethane, and bis(trifluoromethanesulfonyl)imide; $Y^{2-}$ is a divalent counter anion selected from the group consisting of $SiF_6^{2-}$, $GeF_6^{2-}$, $TiF_6^{2-}$, $TaF_7^{2-}$, $NbF_7^{2-}$, $RuCl_6^{2-}$, $OsCl_6^{2-}$, $IrCl_6^{2-}$, $PdCl_4^{2-}$, $PdCl_6^{2-}$, $PdI_4^{2-}$, $PtCl_4^{2-}$, $PtCl_6^{2-}$, $PtBr_6^{2-}$, $IrCl_6^{2-}$, $ZrF_6^{2-}$, benzenedisulfonate, squarate, $B_{12}H_{12}^{2-}$, and $C_{60}^{2-}$.

In a preferred embodiment of the invention, the oxidized oligo arylamine salt is selected from the group consisting of p-TPD-X and p-$TPD_2$-Y where X and Y are mono and divalent counter anions, respectively, and p-TPD is the cation of a para-substituted triarylamine compound with at least one of the para-substituted terminal segments is selected from the partial formulas:

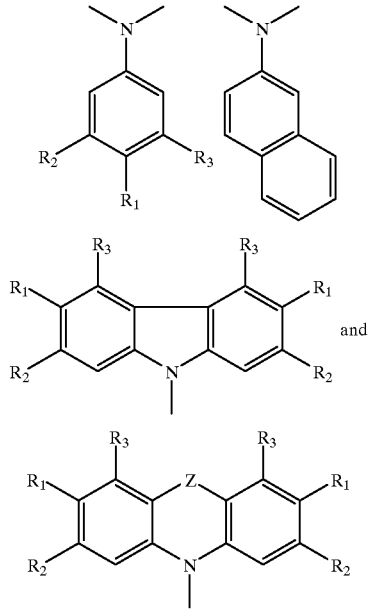

wherein $R_1$ is selected from the group consisting of bromine, chlorine, fluorine, alkyl groups with from about 1 to about 24 carbon atoms, such as methyl, ethyl, butyl, isobutyl, and the like, and alkoxy groups with from about 1 to about 24 carbon atoms, such as methoxy, ethoxy, butoxy, isobutoxy, and the like, $R_2$ and $R_3$ are independently selected from the group consisting of hydrogen, bromine, chlorine, fluorine, alkyl groups with from about 1 to about 24 carbon atoms, and alkoxy groups with from about 1 to about 24 carbon atoms, and Z is an atom of O, S, Se, or a methylene substituent —$CH_2$—. In a particularly preferred embodiment, the oligo-aryamine salt is of the following formula:

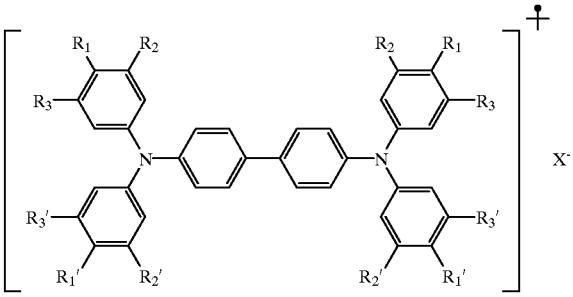

wherein $R_1$ and $R_1'$ are bromine, chlorine, fluorine, alkyl groups with from about 1 to about 24 carbons, alkoxy groups with from about 1 to about 12 carbons, or aromatic groups with carbon number of from about 6 to about 24; $R_2$, $R_3$, $R_2'$, and $R_3'$ are independently selected from the group consisting of hydrogen, bromine, chlorine, fluorine, alkyl groups containing from about 1 to about 24 carbon atoms, and alkoxy groups having a carbon number of from about 1 to about 12, wherein $X^-$ is a monovalent counter anion selected from the group consisting of $SbF_6^-$, $BF_4^-$, $PF_6^-$, $AsF_6^-$, $ClO_4^-$, $AuCl_4^-$, $C_{60}^-$, $I^-$, $Br_3^-$, $I_3^-$, $FeCl_4^-$, $SnCl_5^-$, trifluoroacetate, benzoate, nitrobenzoate, toluenesulfonate, p-bromobenzenesulfonate, p-nitrobenzenesulfonate, trifluoromethanesulfonate, nonafluorobutanesulfonate, and 2,2,2-trifluoroethane-sulfonate. In a particularly preferred embodiment, X— is selected from the group consisting of $SbF_6^-$ and $AsF_6^-$.

The oxidized oligo-arylamine salt is present in the oxidized transport coating in an amount of from about 0.1 to about 80 weight percent with respect to the total weight of charge transport molecules and charge transport polymer binders, preferably from about 0.1 to about 50 weight percent, and particularly preferred from about 1 to about 20 weight percent based on the total weight of charge transport molecules and charge transport polymer binders.

In a particularly preferred embodiment, the charge transport component comprises a triarylamine in an amount of from about 20 to about 60 weight percent based on total coating. In addition, in a particularly preferred embodiment, the polymer binder of the donor member coating comprises a bisphenol polycarbonate in an amount of from about 40 to about 80 weight percent of total coating.

The oxidized transport coatings of the present invention have conductivities of from about $10^{-4}$ to about $10^{-12}$/ohm-cm, and preferably from about $10^{-7}$ to about $10^{-10}$/ohm-cm, which conductivity is controlled by the concentrations of the oxidized oligo arylamine salt and the charge transport units contained in the coatings. The conductive coatings of the present invention using, for example, the aforementioned oligo arylamine salts exhibited excellent electrical stability compared to conductive coatings prepared with other oxidants and as illustrated herein. The conductive polymer coatings, in embodiments of the present invention, have electrical conductivities and mechanical stabilities that can be retained or maintained for an extended time, for example, from about 8 to about 10 weeks at a temperature of, for example, about 85 to about 100° C. and in a relative humidity of about 50 to about 100 percent.

In embodiments, the oxidized transport coating compositions can additionally include optional additives such as an alkaline anti-corrosion additive, and a voltage stabilizing additive. Examples of alkaline anti-corrosion additive include, heterocyclic compounds with at least one nitrogen heteroatom, metallocene compounds, and mixtures thereof, for example, 2-(4-biphenylyl)-5,6-phenyl oxazole, 1,4-dichlorophthalazine, 1-phenyl pyrazole, di-pyridyl anthracenes, 1-phenyl-imidazole, 3-methyl-1-phenyl-pyrazole, 2,4,6-triphenyl-1,3,5-triazine, 2,6-di-t-butylpynidine, 4,7-diphenyl-1,10-phenanthroline, 2,6-bis (chloromethyl)pyridine, 2,5-diphenyl oxazole, 2,4,6-triphenoxy-1,3,5-triazine, 8-hydroxyquinoline aluminum, ferrocene, mixtures thereof, and the like. Many of the aforementioned heterocylic compounds are known electron transport materials. Examples of ionic additives are metal acid salts such as silver trifluoroacetate, lithium difluorochloroacetate, and the like as disclosed in U.S. Pat. No. 5,731,078. These ionic salts can minimize the cumulation of residual voltage in the coatings.

The oxidized transport coatings herein are formed by known methods including dissolving the charge transport molecules and polymer binder in a solvent and subsequently adding the oligo arylamine salt. The solution formed may be coated onto a donor member using known methods such as spraying, dipping, roll coating, flow coating, extrusion, and the like. The solvent is then allowed to evaporate.

The oxidized transport coating on the donor member substrate is coated to a thickness of from about 1 to about 50 microns, preferably from about 5 to about 25 microns.

In a preferred embodiment of the invention, an additional outer protective coating may be present on the oxidized transport layer coating described above. The outer protective layer may comprise inorganic or organic materials with coating thicknesses in the range of from about 10 nm to about 10 micron and preferably from about 0.5 to about 5 micron. The inorganic coatings may comprise polysilicates derived from a sol-gel process and diamond-like nanocomposites derived from plasma deposition. The organic coatings may comprise soluble polymers or cross-linked polymers. Soluble polymers include but not limited to polycarbonates, polyimides, polyamides, polyesters, polysiloxanes, polyesters and mixtures thereof. Crosslinked polymers can be selected from but not limited to thermal or radiation curable vinyl or epoxy monomers, oligomers and polymers, unsaturated polyesters, polyamides, carbazole containing polymers, thiophene containing polymers, bistriarylamine containing polymers, and mixtures thereof. The organic coatings may contain additives in the range of from about 0.1 to about 50 percent by weight of the protective coatings. The additives include, but are not limited to, charge transport molecules and oxidants, the oxidized charge transport molecule salts, and particulate fillers such as silica, TEFLON® powder, carbon fibers, carbon black and mixtures thereof.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

A preferred oxidized transport layer (OTL) consists of a charge transport molecule (35–40 weight percent), a binder polymer (65–60 weight percent), and an oligo arylamine salt (1–50 weight percent based on the weight of the charge transport molecule). A preferred oxidant is 4,4'-Di-t-butylphenyl iodonium hexafluoroantimonate (DBPI-$AsF_6$), which is a photoacid which required UV exposure to activate its oxidative power. The oxidized salts of N,N,N',N'-tetratolyl-1,1'-p-biphenyl-4,4'-diamine (TTDA) are the preferred oligo arylamine salts. The synthesis of DBPI-$AsF_6$ can be found in U.S. Pat No. 5,587,224 (1996). The synthesis of TTDA-$SbF_6$ salt is given below:

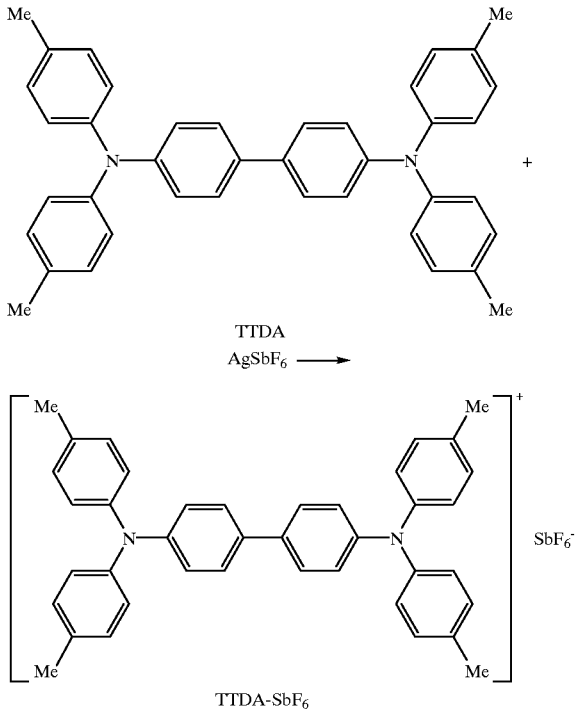

An amount of 60.0 g, 0.11 mol TTDA and methylene chloride (250 ml) were added to a single neck flask (1L) equipped with a magnetic stirrer. To this solution, the solution of $AgSbF_6$ (34.4 g, 0.10 mol) in methylene chloride (250 ml) was added dropwise for about 2 hours. The resulting brown solution was filtered and the silver residue was rinsed with methylene chloride (50 ml). Hexanes (1500 ml) were slowly added to the combined methylene chloride solution for about 1 hour to give a blue solid (note 2). After filtering and drying at 40° C. and 15 torr, for about 1 day (24 hours) a blue solid (76.8 g, 98.5% yield) was obtained which showed UV spectrum: 281, 362, 491 nm and mass spectrum (ESI/MS): M/Z $544.4^+$. It should be noted that simultaneous charging of TTDA, $AgSbF_6$, and methylene chloride in a pot gave an impure product containing a dication complex. In addition, last addition of hexanes to the methylene chloride solution gave an impure product containing the starting TTDA.

Example 2

The following spray coating formulation of MAKROLON® 3108 (37.05 g), N,N'-diphenyl-N,N'-di(3-methylphenyl)-1.1'-biphenyl-4,4'-diamine (TPD) (19.95 g), TTDA-$SbF_6$ or DBPI-$AsF_6$ (0.2 g), methylene chloride (546 ml or 723 g) and 1,1,2-trichloroethane (344 ml or 494 g), in a 1 liter amber bottle was roll milled in a MAKROLON® 5705 (3 g), TPD (1.6 g), TTDA-$SbF_6$ or DBPI-$AsF_6$ (16 mg), methylene chloride (34 g) and optional silver trifluoroacetate (AgTFA) (6.4 mg) mixture. The spray coating was performed in a commercial spray booth with temperature and humidity control and in a clean room environment. Six aluminum roll substrates, each having two end shafts onto which the coating was to be applied, were cleaned with methylene chloride and air-dried to remove the solvent. The rolls were mounted in a vertical holder mechanism that allowed for rotation at a predetermined rotation rate. The spray gun used to spray coat was a commercially available Binks Spray Gun with control of the solution feed rate, atomization pressure and fan angle of the solution spray pattern. The spray gun was mounted on a reciprocator that enabled uniform vertical movement and spray coating onto the entire surface of the rolls. The conditions were adjusted such that a uniform coating was obtained on the surface of the rolls with 3 to 4 spray passes. The coatings were dried in a forced air oven at 50° C. and 120° C. for about 30 minutes each. The thickness of the coating on the rolls was measured with use of a permascope.

Ultraviolet exposure is needed for coatings using DBPI-$AsF_6$, as has been described in U.S. Pat No. 5,587,224 (1996). Table 1 shows the physical characteristics of the 6 spray coated rolls in terms of surface roughness (Ra), waviness (Wt), total indicator runout (TIR) and thickness and uniformity. Rolls 5 and 6 have an undercoat layer of AgTFA (20 weight percent) in a polyester 49K resin (available form duPont). This underlayer was spray coated using the following coating solution: 49K (4.0 g), AgTFA (1.0 g), tetrahydrofuran (500 g). The rolls were formed by the just-described process and found to be pin-hole free.

TABLE 1

Physical Characterization for Coated Rolls

| Roll ID | Composition of the relaxation layer | Ra (micron) | Wt (micron) | TIR (micron) | Thickness / Uniformity (micron) |
|---|---|---|---|---|---|
| 1 | MAKROLON ® 3108/TPD/ TTDA-$SbF_6$: 65/35/1 | 0.21 | 2.1 | — | 11/7.6 |
| 2 | MAKROLON ® 3108/TPD/ TTDA-$SbF_6$: 70/30/1 | 0.19 | 4.5 | — | 32/10 |

TABLE 1-continued

Physical Characterization for Coated Rolls

| Roll ID | Composition of the relaxation layer | Ra (micron) | Wt (micron) | TIR (micron) | Thickness / Uniformity (micron) |
|---|---|---|---|---|---|
| 3 | MAKROLON ® 3108/TPD/DBPI-$AsF_6$: 65/35/1 | 0.2 | 2.26 | 27.45 | 17.4/4.80 |
| 4 | MAKROLON ® 3108/TPD/TTDA-$SbF_6$/AgTFA 65135/1/1 | 0.23 | 2.0 | 30.2 | 20.4/3.90 |
| 5 | MAKROLON ® 3108/TPD/DBPI-$ASF_6$: 65/35/1 with AgTFA:49K undercoat | 0.21 | 3.34 | 40.13 | 17.0/4.82 |
| 6 | MAKROLON ® 3108/TPD/TTDA-$SbF_6$: 70130/1 with AgTFA:49K undercoat | 0.27 | 4.1 | 31.46 | 19.0/9.07 |

The electrical properties of the 6 pinhole-free rolls are set forth in Table 2 in terms of current density at 400 and at 100 V, capacitance (Cap), rectifying ratios at 400 and at 100 V, I/V linearity, and percent current drop at 400 V over 5 minutes. The I/V linearity was based on the ratio resistivity at 100 V over resistivity at 400 V. The use of AgTFA (Rolls 4, 5 and 6) reduced the rectifying ratio and the percent of current drop. Low rectifying ratio represents a resistor-like havior; while high rectifying ratio represents a diode like behavior. A resistor-like behavior is needed for donor roll application. The compound AgTFA is an ionic compound, which may facilitate charge injection across interface and thus improve the electrical properties.

TABLE 2

Electrical Properties of Donor Rolls

| Roll ID | Composition of the relaxation layer | Current Density @400 V @100 V (mA/($cm^2$) | Cap, pF | I/V Linearity $R_{100\ V}/R_{40}$ 0 V | Rectifying ratio @400 V @100 V | Percent current drop @ 400 V over 5 min |
|---|---|---|---|---|---|---|
| 1 | MAKROLON ® 3108/TPD/TTDA-$SbF_6$: 65/35/1 | 90.0 7.3 | 14 | 4.0 | 2.1 3.2 | 12% |
| 2 | MAKROLON ® 3108/TPD/TTDA-$SbF_6$: 70/30/1 | 78.8 4.9 | 10 | 3.96 | 1.75 2.90 | 10% |
| 3 | MAKROLON ® 3108/TPD/DBPI-$AsF_6$: 65/35/1 | 390 23.4 | 67 | 4.17 | 1.57 2.20 | 13% |
| 4 | MAKROLON ® 3108/TPD/TTDA-$SbF_6$/AgTFA: 65/35/1/1 | 98.2 8.4 | 12 | 3.94 | 1.10 1.22 | 5% |
| 5 | MAKROLON ® 3108/TPD/DBPI-$AsF_6$: 65/35/1 with AgTFA:49K undercoat | 323 20.0 | 62 | 3.97 | 1.13 1.21 | 5% |
| 6 | MAKROLON ® 3108/TPD/TTDA-$SbF_6$: 70/30/1 with AgTFA:49K undercoat | 136 8.8 | 26 | 3.88 | 1.08 1.35 | 7% |

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

We claim:

1. An apparatus for developing a latent image recorded on a surface, comprising:

a) wire supports;

b) a donor member spaced from the surface and able to transport toner to a region opposed from the surface, wherein said donor member comprises a substrate and having thereover an oxidized transport coating comprising charge transport molecules, polymer binder, and an oxidized oligo arylamine salt comprising an oligo arylamine cation and a counter anion wherein said oxidized oligo arylamine salt comprises more than two arylamine monomers; and, further comprising an outer protective layer positioned on said oxidized transport coating; and c) an electrode member positioned in the space between the surface and said donor member, said electrode member being spaced a distance from said donor member and being electrically biased to detach toner from said donor member thereby enabling the formation of a toner cloud in the space between said electrode member and the surface with detached toner from the toner cloud developing the latent image.

2. An apparatus in accordance with claim 1, wherein said oxidized oligo arylamine salt is of a formula selected from the group consisting of TM-X and $(TM)_2$-Y, wherein TM is a oxidized oligo arylamine cation and X is a monovalent counterion seiected from the group consisting of $BF_4^-$, $PF_6^-$, $AsF_6^-$, $SbF_6^-$, $ClO_4^-$, $AuCl_4^-$, $C_{60}^-$, $I^-$, $Br_3^-$, $I_3^-$, $FeCl_4^-$, $SnCl_5^-$, $PO_3^-$, $(CF_3SO_3)_4Al^-$, $(CF_3SO_3)_4Ga^-$, $(CF_3SO_3)_4Ta^-$, $(CF_3SO_3)_4B^-$, trifluoroacetate, benzoate, nitrobenzoate, toluenesulfonate, p-bromobenzenesulfonate, p-nitrobenzenesulfonate, trifluoromethanesulfonate, nonafluorobutanesulfonate, 2,2,2-trifluoroethanesulfonate, tetraphenylborate, anionic tetracyanoquinodimethane, and bis(trifluoromethanesulfonyl)imide, and wherein $Y^2$ is a divalent counter anion selected from the group consisting of $SiF_6^{2-}$, $GeF_6^{2-}$, $TiF_6^{2-}$, $TaF_7^{2-}$, $NbF_7^{2-}$, $RuCl_6^{2-}$, $OsCl_6^{2-}$, $IrCl_6^{2-}$, $PdCl_4^{2-}$, $PdCl_6^{2-}$, $PdI_4^{2-}$, $PtCl_4^{2-}$, $PtCl_6^{2-}$, $PtBr_6^{2-}$, $IrCl_6^{2}$, $ZrF_6^{2-}$, squarate, benzenedisulfonate, $B_{12}H_{12}^{2-}$, and $C_{60}^{2-}$.

3. An apparatus in accordance with claim 2, wherein said oxidized oligo arylamine salt is of the formula TM-X, and X is selected from the group consisting of $AsF_6$ and $SbF_6$.

4. An apparatus in accordance with claim 1, wherein said oxidized oligo arylamine salt is of a formula selected from the group consisting of:

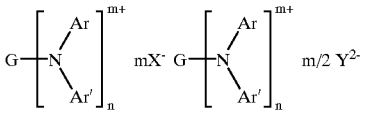

and mixtures thereof, wherein G is an aromatic group with from about 6 to about 24 carbon atoms and connects to all the diarylamine groups, Ar and Ar' are substituted or unsubstituted aromatic groups with from about 6 to about 18 carbon atoms, n is an integer of from about 2 to about 36, m is an integer which is less than or equal to n, $X^-$ is a monovalent counter anion selected from the group consisting of $BF_4^-$, $PF_6^-$, $AsF_6^-$, $SbF_6^-$, $ClO_4^-$, $AuCl_4^-$, $C_{60}^-$, $I^-$, $Br_3^-$, $I_3^-$, $FeCl_4^-$, $SnCl_5^-$, $PO_3^-$, $(CF_3SO_3)_4Al^-$, $(CF_3SO_3)_4Ga^-$, $(CF_3SO_3)_4Ta^-$, $(CF_3SO_3)_4B^-$, trifluoroaceate, benzoate, nitrobenzoate, toluenesulfonate, p-bromobenzenesulfonate, p-nitrobenzenesulfonate, trifluoromethanesulfonate, nonafluorobutanesulfonate, 2,2,2-trifluoroethanesulfonate, tetraphenylborate, anionic tetracyanoquinodimethane, and bis(trifluoromethanesulfonyl)imide, $Y^{2-}$ is a divalent counter anion selected from the group consisting of $SiF_6^{2-}$, $GeF_6^{2-}$, $TiF_6^{2-}$, $TaF_7^{2-}$, $NbF_7^{2-}$, $RuCl_6^{2-}$, $OsCl_6^{2-}$, $IrCl_6^{2-}$, $PdCl_4^{2-}$, $PdCl_6^{2-}$, $PdI_4^{2-}$, $PtCl_4^{2-}$, $PtCl_6^{2-}$, $PtBr_6^{2-}$, $IrCl_6^{2-}$, $ZrF_6^{2-}$, benzenedisulfonate, squarate, $B_{12}H_{12}^{2-}$, and $C_{60}^{2-}$.

5. An apparatus in accordance with claim 1, wherein said oxidized oligo arylamine salt is of a formula

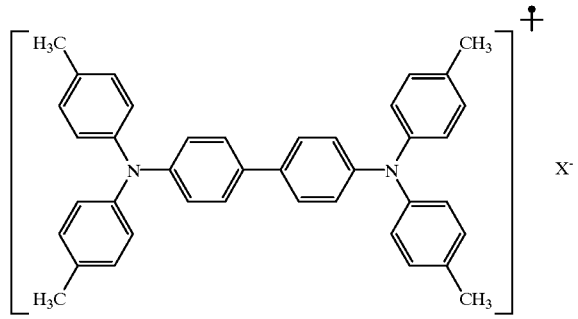

wherein $X^-$ is a monovalent counter anion selected from the group consisting of $BF_4^-$, $PF_6^-$, $AsF_6^-$, $SbF_6^-$, $ClO_4^-$, $AuCl_4^-$, $C_{60}^-$, $I^-$, $Br_3^-$, $I_3^-$, $FeCl_4^-$, $SnCl_5^-$, $PO_3^-$, $(CF_3SO_3)_4Al^-$, $(CF_3SO_3)_4Ga^-$, $(CF_3SO_3)_4Ta^-$, $(CF_3SO_3)_4B^-$, trifluoroacetate, benzoate, nitrobenzoate, toluenesulfonate, p-bromobenzenesulfonate, p-nitrobenzenesulfonate, trifluoromethanesulfonate, nonafluorobutanesulfonate, 2,2,2-trifluoroethanesulfonate, tetraphenylborate, anionic tetracyanoquinodimethane, and bis(trifluoromethanesulfonyl)imide.

6. An apparatus in accordance with claim 5, wherein X is selected from the group consisting of $SbF_6^-$ and $AsF_6^-$.

7. An apparatus in accordance with claim 5, wherein said oxidized oligo arylamine salt is present in an amount of from about 0.1 to about 80 percent by weight with respect to the total weight of charge transport molecules and polymer binders.

8. An apparatus in accordance with claim 5, wherein said oxidized oligo arylamine salt is present in an amount of about 0.1 to about 20 percent by weight with respect to the total weight of charge transport molecules and polymer binders.

9. An apparatus in accordance with claim 1, wherein said oxidized oligo arylamine molecule is a para-substituted aryl amine compound.

10. An apparatus in accordance with claim 1, wherein said binder comprises a material selected from the group consisting of polystyrenes, polycarbonates, polysiloxanes, polyesters, polyimides, polyurethanes, polysulfones, polyethersulfones, polyether ketones, polyamides and mixtures thereof.

11. An apparatus in accordance with claim 10, wherein said binder comprises polycarbonate.

12. An apparatus in accordance with claim 1, wherein said oxidized transport coating has a conductivity of from about of $10^{-4}$ to about $10^{-12}$/ohm-cm.

13. An apparatus in accordance with claim 12, wherein said oxidized transport coating has a conductivity of from about $10^{-7}$ to about $10^{-10}$/ohm-cm.

14. An apparatus in accordance with claim 1, wherein said charge transport molecule is present in the oxidized transport coating in an amount of from about 1 to about 80 percent based on the weight of total coating.

15. An apparatus in accordance with claim 14, wherein said charge transport molecule is present in said oxidized transport coating in an amount of from about 20 to about 60 weight percent based on the weight of total coating.

16. An apparatus in accordance with claim 1, wherein said polymer binder comprises a bisphenol polycarbonate in an amount of from about 40 to about 80 weight percent based on the weight of total coating.

17. An apparatus in accordance with claim 1, wherein said polymer binder is present in the oxidized transport coating in an amount of from about 20 to about 99 weight percent based on the weight of total coating.

18. An apparatus in accordance with claim 1, wherein said substrate is in the form of a cylindrical roll.

19. An apparatus in accordance with claim 1, wherein said oxidized transport coating has a thickness of from about 1 to about 50 microns.

20. An apparatus in accordance with claim 1, wherein said outer protective layer comprises a material selected from the group consisting of polycarbonates, polyimides, polyamides, polysiloxanes, and mixtures thereof.

* * * * *